US005365221A

United States Patent [19]

Fennell et al.

[11] Patent Number: 5,365,221

[45] Date of Patent: Nov. 15, 1994

[54] COMPUTER CARD HAVING LOW BATTERY INDICATOR

[75] Inventors: Robert D. Fennell, Coral Springs; Gregory L. Cannon, Delray Beach; William J. Macko, West Palm Beach; Gregory W. Fuller, Boca Raton, all of Fla.

[73] Assignee: Motorola, Inc., Schaumburg, Ill.

[21] Appl. No.: 963,957

[22] Filed: Oct. 19, 1992

[51] Int. Cl.[5] ..... G08B 21/00

[52] U.S. Cl. ..... 340/636; 320/48; 364/707

[58] Field of Search ..... 340/636; 320/48; 364/707, 710.12

[56] References Cited

U.S. PATENT DOCUMENTS

| | | | |
|---|---|---|---|
| 4,247,908 | 1/1981 | Lockhart, Jr. et al. | 364/900 |
| 5,043,721 | 8/1991 | May | 340/825.44 |
| 5,072,103 | 12/1991 | Narz | 235/492 |
| 5,157,247 | 10/1992 | Takahira | 235/492 |
| 5,262,868 | 11/1993 | Kaneko et al. | 358/209 |

OTHER PUBLICATIONS

"PC Card Standard", Release 2.0, Sep., '91, Personal Computer Memory Card International Association, Sunnyvale, Calif.

*Primary Examiner*—John K. Peng
*Assistant Examiner*—Edward Lefkowitz
*Attorney, Agent, or Firm*—Kelly A. Gardner

[57] ABSTRACT

A battery powered electronic device (105) for coupling to a host computer (205 ) comprises an interface (115) for transmitting data and an annunciator (340) for generating a sensible alert. The electronic device (105) further comprises interface monitoring circuitry (320) coupled to the interface (115) for determining an interface status as being active or inactive and voltage monitoring circuitry (360) coupled to a battery (355) for monitoring the battery voltage. Threshold detection circuitry (360) coupled to the voltage monitoring circuitry (360) detects that the battery voltage has exceeded a predetermined threshold voltage and generates a low battery signal in response thereto. A controller (320) receives the low battery signal and, in response thereto, provides a low battery indication to the interface (115) when the interface (115) has an active status and provides an activation signal to the annunciator (340) when the interface (115) has an inactive status.

17 Claims, 3 Drawing Sheets

COMPUTER CARD HAVING LOW BATTERY INDICATOR

FIELD OF THE INVENTION

This invention relates in general to computer cards for use with a host computer, and more specifically to a computer card having a low battery indicator.

BACKGROUND OF THE INVENTION

Conventionally, users of computing devices, such as personal computers, utilize computer cards which are inserted into the host computer to provide hardware expansion or peripheral functions. For example, computer cards may provide memory expansion, data storage, or input/output functions. Many of these computer cards are manufactured in accordance with PCMCIA (Personal Computer Memory Card International Association) standards and are therefore referred to as PCMCIA cards. PCMCIA cards utilize a standardized sixty-eight (68) pin interface for easy interchangeability between different host computers.

Computer cards typically include a battery to provide power for retention of information in memory and for peripheral operations, such as input/output functions. Because the computer cards are relatively small in size, the battery, such as a lithium cell, is usually very small, resulting in limited battery capacity. When the battery voltage drops below a predetermined threshold, a pin of the interface is held low by a controller within the computer card. When the computer card is coupled to a host computer, the computer recognizes the low pin voltage as an indication of low battery voltage. Thereafter, a message may be displayed by the computer to alert a user as to the low voltage condition of the battery. Additionally, some computer cards are capable of generating an audio wave form to drive a host computer's loudspeaker when the battery voltage drops below the threshold. In this manner, the user is conveniently alerted by an audible tone.

However, most computer cards, such as PCMCIA cards, are unable to independently alert a user of a low battery condition. As a result, a low battery condition cannot be recognized by the user unless the card is coupled to a host computer. This is not typically a problem in computer cards that are employed solely for purposes of memory expansion, as memory expansion cards are usually intended to remain coupled to the host computer. Furthermore, memory expansion cards generally consume only minimal amounts of current. Therefore, the battery utilized by memory expansion cards may last several years.

In computer cards providing peripheral functions, however, current is typically consumed at a much higher rate, thereby significantly decreasing the life of the battery. Additionally, some peripheral cards, such as radio frequency (RF) modems, are intended to function when detached from the host computer. As a result, there is a risk that a low battery condition could occur when such a peripheral card is detached from the host computer. Because, as described ,above, typical computer cards are unable to independently alert a user to a low battery condition, the low battery condition could go unnoticed by the user for a long period of time during which the computer card is not coupled to the computer. If this occurs, the battery voltage could drop too low to power the computer card, thus inconveniently causing the loss of any information residing in the memory of the computer card.

Thus, what is needed is a computer card, such as a PCMCIA card, which is able to independently provide a low battery indication to a user.

SUMMARY OF THE INVENTION

An electronic device powered by a battery has an interface for transmitting data to a host computer and an annunciator for generating an alert. A method in the electronic device for providing a low battery indication comprises the steps of monitoring the battery voltage and determining that the battery voltage has fallen below a predetermined threshold voltage. In response to determining that the battery voltage has fallen below the predetermined threshold, a low battery indication is provided to the interface only when the interface is coupled to the host computer. Alternatively, when the battery voltage has fallen below the predetermined threshold, the annunciator is activated only when the interface is not coupled to the host computer.

A battery powered electronic device has an interface for transmitting data to a host computer. The electronic device further includes an annunciator for generating an alert, interface monitoring circuitry coupled to the interface for determining an interface status as being active or inactive, and voltage monitoring circuitry coupled to a battery for monitoring the battery voltage. A threshold detector coupled to the voltage monitoring circuitry detects when the battery voltage has fallen below a predetermined threshold voltage and generates a low battery signal in response thereto. A controller receives the low battery signal, wherein the controller, in response to reception of the low battery signal, provides a low battery indication to the interface only when the interface has an active status and provides an activation signal to the annunciator only when the interface has an inactive status.

DESCRIPTION OF A PREFERRED EMBODIMENT

Figure 1:
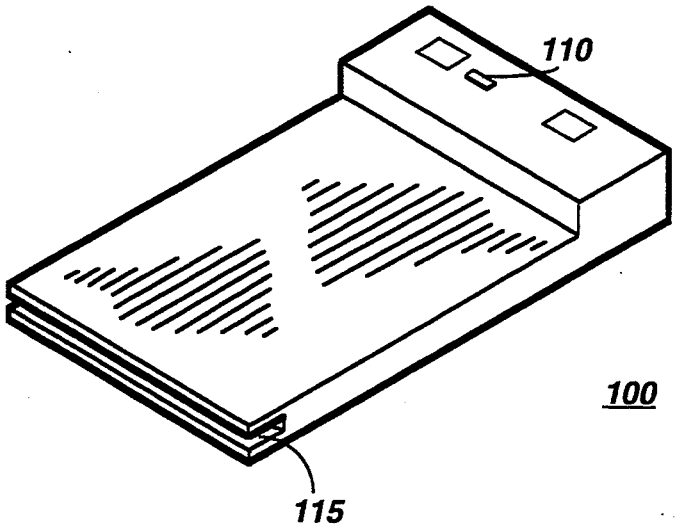
FIG. 1 is an illustration of a data communication receiver in accordance with a preferred embodiment of the present invention.

Referring to FIG. 1, a computer card, preferably manufactured in accordance with PCMCIA (Personal Computer Memory Card International Association) standards, is depicted. This computer card may be a memory expansion card or, in accordance -with a preferred embodiment of the present invention, a data communication receiver 100 . The data communication receiver 100 preferably receives a radio frequency (RF)

signal and recovers a selective call message contained therein. The selective call message is stored by the data communication receiver 100 and thereafter may be processed in response to user manipulation of controls 110 located on the exterior of the data communication receiver 100. Alternatively, the selective call message may be automatically transferred, via a standard PCMCIA interface 115, to a host computer, as may be better understood by referring to FIG. 2.

Figure 2:
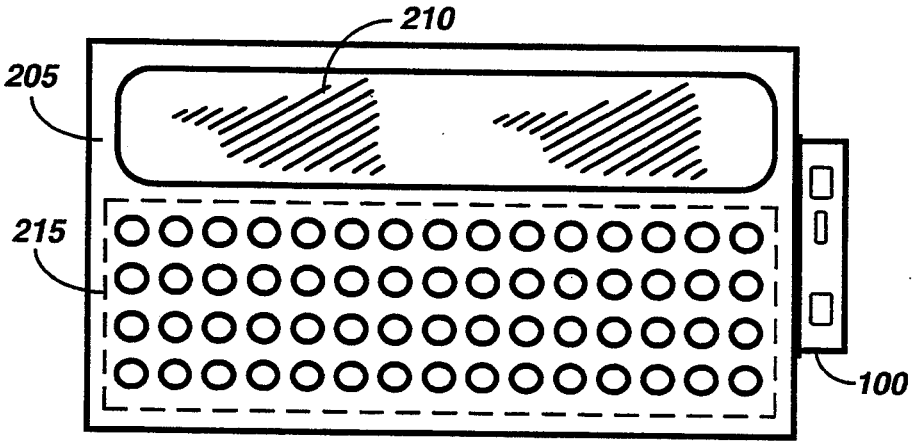
FIG. 2 is an illustration of the interactive coupling of the data communication receiver of FIG. 1 to a host computer in accordance with the preferred embodiment of the present invention.

FIG. 2 depicts the interactive coupling of the data communication receiver 100 to a host computer 205. As shown, the data communication receiver 100 is inserted within a card-receiving pocket wherein the interface 115 (FIG. 1) electrically couples with a computer interface located within the card-receiving pocket. In this position, data, such as selective call messages, is transferred to the host computer 205 via the interface 115 and the computer interface. Thereafter, according to the present invention, the transferred data is displayed on the monitor 210 of the host computer 205 either manually, when commands are entered on a computer keyboard 215, or automatically. Additionally, information may be transferred from the host computer 205 to the data communication receiver 100.

Figure 3:
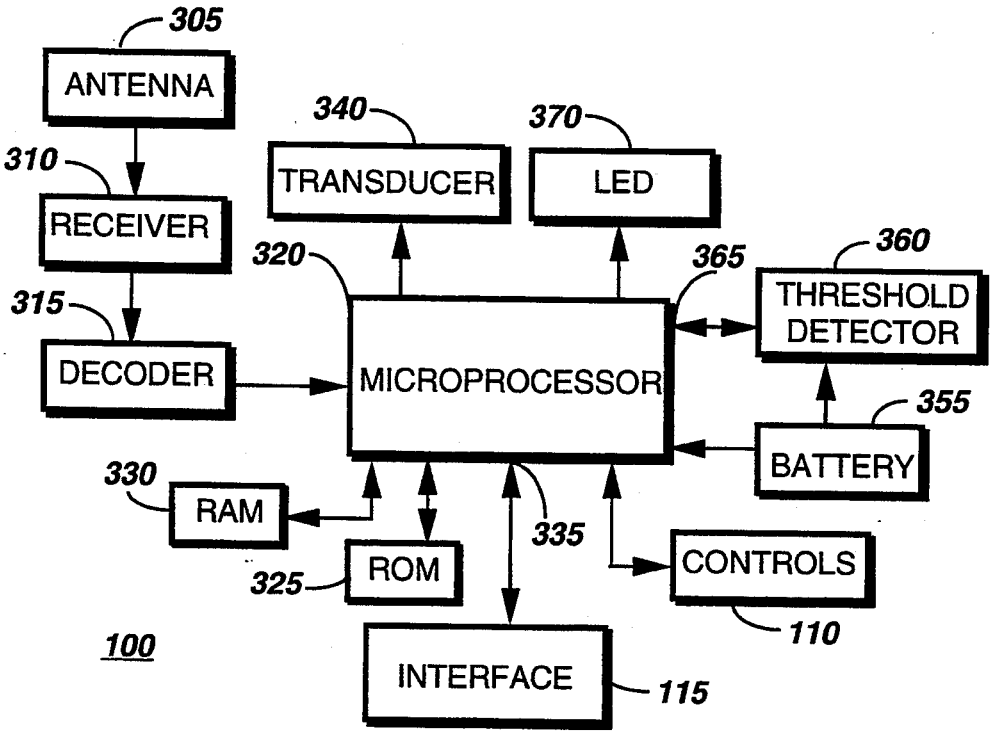
FIG. 3 is an electrical block diagram of the data communication receiver of FIG. 1 in accordance with the preferred embodiment of the present invention.

Referring next to FIG. 3, an electrical block diagram of the data communication receiver 100 is shown. According to the present invention, an RF signal is received by an antenna 305 and provided to a receiver 310, which demodulates the RF signal. Thereafter, a decoder 315 coupled to the receiver 310 recovers an address and a selective call message included within the RF signal. A microprocessor 320, which controls the operation of the data communication receiver 100, compares the recovered address with addresses stored in a read only memory (ROM) 325, such as an electrically erasable programmable read only memory (EEPROM), to determine whether the selective call message is intended for reception by the data communication receiver 100. If so, the microprocessor 320 stores the selective call message in a random access memory (RAM) 330.

As described above, the data communication receiver 100 preferably includes a PCMCIA interface 115, which is coupled to the microprocessor 320. In accordance with the preferred embodiment of the present invention, the interface 115 couples the data communication receiver 100 to a host computer 205 (FIG. 2), thus providing for the transfer of data between the data communication receiver 100 and the computer 205. Preferably, the microprocessor 320 monitors an interface port 335 to which the interface 115 is connected to determine the interface status as being active, i.e., the interface 115 is coupled to the computer 205, or inactive, i.e., the interface 115 is not coupled to the computer 205.

Upon reception and storage of a selective call message, the microprocessor 320 provides, when the interface 115 is inactive, an activation signal to a transducer 340 coupled to the microprocessor 320. In response to reception of the activation signal, the transducer 340 generates an audible tone to announce reception of the selective call message. When the interface 115 is active, a message reception signal is preferably provided to the interface 115 for subsequent transmission to the computer 205. The computer 205 may thereafter generate a sensible alert, such as an audible tone or a message visibly presented on the monitor 210 (FIG. 2), to announce reception of the selective call message. Additionally, the selective call message itself is transferred from the RAM 330 to the computer 205 for subsequent display when the interface 115 is active.

Further coupled to the microprocessor 320 is a battery 355, such as a lithium cell, for powering the data communication receiver 100. In accordance with the preferred embodiment of the present invention, a threshold detector 360 is coupled to the battery 355 for monitoring the battery voltage. When the battery voltage drops below a predetermined threshold voltage, the threshold detector 360 provides a low battery signal at a threshold detector port 365 of the microprocessor 320. When the interface 115 is active, i.e., the data communication receiver 100 is coupled to the computer 205, the microprocessor 320 provides a low battery indication to the interface 115 for subsequent transmission to the computer 205. Preferably, the computer 205 thereafter announces the low battery condition to a user. In this manner, current necessary to power an annunciator is provided by the computer 205, rather than the nearly depleted battery 355 of the data communication receiver 100.

When the data communication receiver 100 is detached from the host computer 205, i.e., when the interface 115 is inactive, the data communication receiver microprocessor 320, in response to reception of the low battery signal generated by the threshold detector 360, provides a sufficient current to drive a light source, e.g., a light emitting diode (LED) 370, located on the exterior of the data communication receiver 100. Preferably, the LED 370 generates a flashing light to announce the low battery condition. It may be appreciated by one skilled in the art that the low battery condition could be alternatively indicated to the user through use of other methods, such as by an audible tone, preferably different than that generated to announce reception of a selective call message, generated by an output device, such as the transducer 340.

According to the present invention, a low battery condition may be announced to a user by the host computer 205 (FIG. 2) coupled to the data communication receiver 100. Alternatively, the low battery condition may be announced by a sensible alert generated by an output device, such as the LED 370 or the transducer 340 of the data communication receiver 100. In this manner, the user is conveniently informed when the battery 355 needs to be replaced. Therefore, the user may avoid situations in which the battery voltage drops too low to power the data communication receiver 100, in which case all information, such as stored selective call messages, residing in the RAM 330 would be lost. Additionally, further operations, such as message reception, would not be performed when the battery 355 is depleted.

Such a feature, i.e., the low battery indicating feature, is extremely advantageous for use in the data communication receiver 100, which, when performing operations such as receiving, processing, and alerting, consumes a relatively large amount of current. Furthermore, since the data communication receiver 100 is intended for use both when coupled to and detached from the host computer 205, the current drain on the battery 355 does not necessarily decrease when the data communication receiver 100 is detached from the host computer 205. As a result, there is a substantial likelihood that the battery 355 could drop below the low battery threshold voltage when the data communication receiver 100 is detached from the host computer 205. The data communication receiver 100 could, for example, be removed from the host computer 205 to allow the use of another computer card, such as a memory card, or to carry the data communication receiver 100 to another host computer. When removed from the host computer 205, the data communication receiver 100 preferably continues to receive and process selective call messages.

On the other hand, unlike the data communication receiver 100 in accordance with the preferred embodiment of the present invention, other computer cards, such as memory cards, do not include a low battery indicator that is able to operate independently. The other computer cards do, however, have need of the present invention since they, like the data communication receiver 100, may be detached from a host computer for various reasons, such as when a different card is to be used. During periods of time when a computer card is detached from a host computer, the computer card continues to draw current, if only for memory support, thereby draining the battery. Therefore, a low battery condition Could occur when the computer card is detached from the host computer and be unrecognized by the user. As a result, if a low battery condition occurs when the computer card is not coupled to a host computer, the low battery condition may not be noticed until the battery voltage has dropped too low to support the operations of the computer card, thus causing loss of memory.

Figure 4:
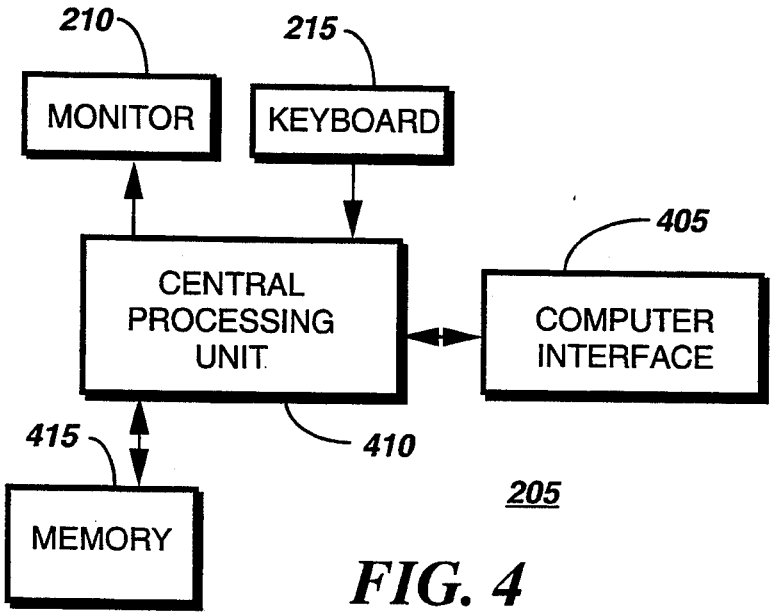
FIG. 4 is an electrical block diagram of the computer of FIG. 2 in accordance with the preferred embodiment of the present invention.

With reference to FIG. 4, an electrical block diagram of the host computer 205 is depicted. In accordance with the preferred embodiment of the present invention, the computer 205 receives data from the data communication receiver 100 via a computer interface 405 manufactured in accordance with PCMCIA standards. The data is provided to a central processing unit (CPU) 410, which thereafter stores the data in a memory 415. The data may then be automatically provided to the monitor 210 for display to a user. Alternatively, the data may be retrieved from the memory 415 and provided to the monitor 210 upon entry of an appropriate command into the keyboard 215.

Figure 5:
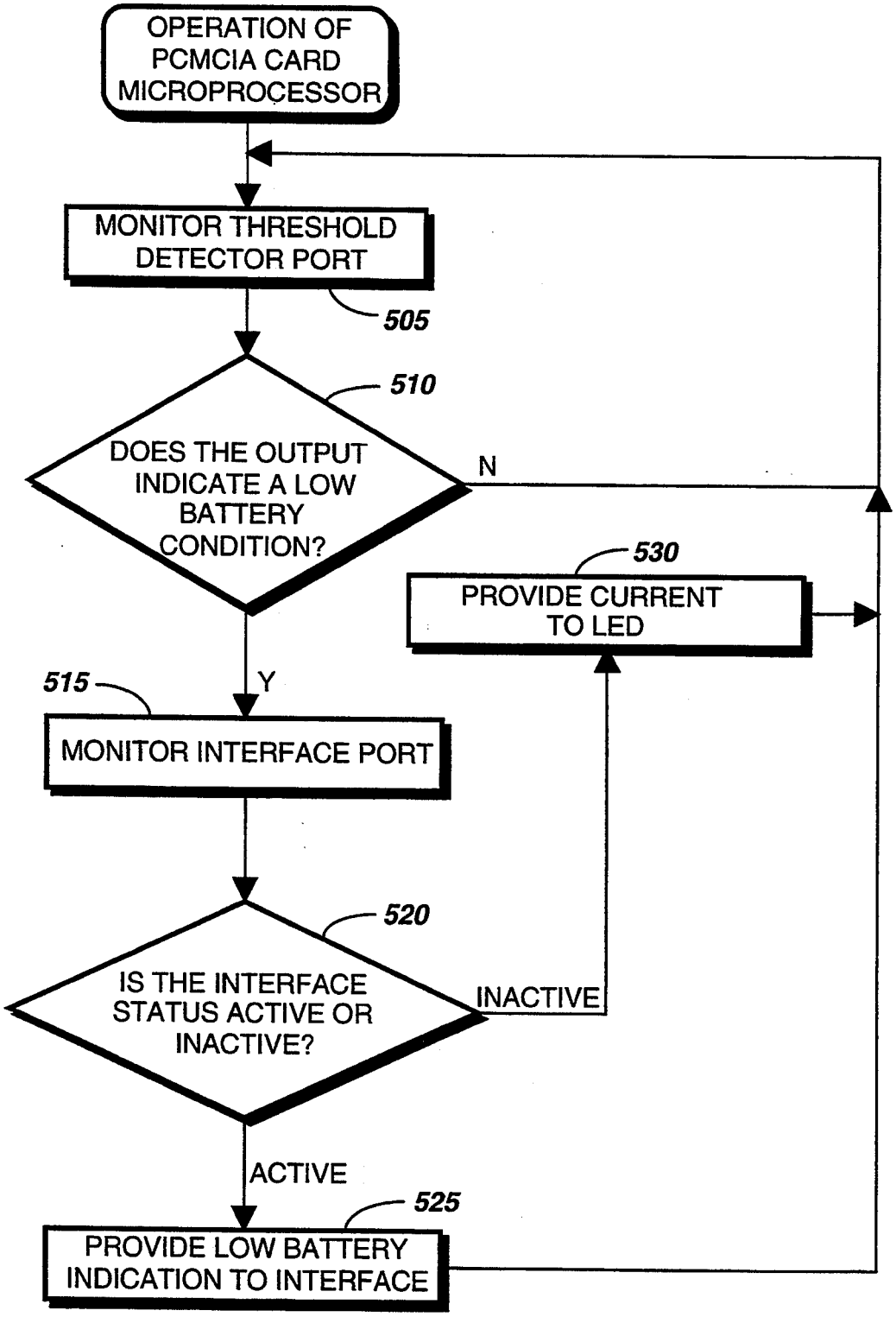
FIG. 5 is a flowchart depicting the operation of the microprocessor of the data communication receiver of FIG. 1 in accordance with the preferred embodiment of the present invention.

Referring next to FIG. 5, a flowchart illustrates the operation of the microprocessor 320 of the data communication receiver 100. According to the present invention, the microprocessor 320 continuously monitors, at step 505, the output of the threshold detector 360 (FIG. 3) at the threshold detector port 365. When the output of the threshold detector 360 indicates, at step 510, that the battery voltage has exceeded a predetermined threshold voltage, the microprocessor 320 monitors, at step 515, the interface port 335 to which the interface 115 is coupled. If the voltage level an the interface port 335 indicates, at step 520, that the interface 115 is active, i.e., the data communication receiver 100 is coupled to the computer 205, the microprocessor 320 provides, at step 525, a low battery indication to the interface 115. Thereafter, the interface 115 transfers the low battery indication to the computer 205, in response to which the computer 205 generates a sensible alert indicating that the battery 355 should be replaced. If the interface 115 is inactive, the microprocessor 320 provides, at step 425, a current to the LED 370, in response to which an visible alert is generated. In this manner, a low battery condition is announced even when the data communication receiver 100 is not coupled to the host computer 205.

Although, according to the preferred embodiment of the present invention, the low battery indication is provided to the host computer 205 when coupled to the data communication receiver 100, it may be appreciated that, in alternate embodiments, the low battery condition may always be announced through use of an output device employed by the data communication receiver. In such alternate embodiments, the user would be alerted of the low battery condition by a sensible alert generated by the data communication receiver whether or not the data communication receiver is coupled to the computer. In still other alternate embodiments of the present invention, the low battery condition may be announced by both the data communication receiver and the host computer.

In summary, the computer card in accordance with the preferred embodiment of the present invention, i.e., the data communication receiver, has the ability to independently alert a user of a low battery condition. According to the present invention, when coupled to the host computer, the computer card detects the low battery condition and transmits a low battery signal to the host computer. The host computer, in response to reception of the low battery signal, alerts the user to the low battery condition, perhaps by displaying an appropriate message on the monitor.

Alternatively, when not coupled to the host computer, the computer card is able to independently generate a sensible alert, such as an audible tone or a visibly displayed message, to announce that the battery voltage has dropped below the predetermined threshold. Therefore, the user is informed of the low battery condition even when the computer card is not coupled to the host computer, for example, when the computer card is carried to another host computer or simply removed to allow the use of a different computer card. This feature is especially advantageous for use with the computer card according to the present invention, i.e., a data communication receiver, which is intended for operation both when coupled to and detached from the host computer. Because the data communication receiver consumes relatively large amounts of current during operation, there is a substantial likelihood that a low battery condition could occur when the data communication receiver is not coupled to the host computer, in which case the data communication receiver independently generates an alert to warn the user.

Conventional computer cards, unlike the computer card in accordance with the preferred embodiment of the present invention, cannot independently alert a user of a low battery condition. Therefore, the user may not be aware that the battery is nearing depletion unless the card is coupled to the host computer. As a result, if a low battery condition occurs when the computer card is not coupled to the host computer, the low battery condition may go unnoticed until the battery voltage has dropped too low the support the operations of the computer card, resulting in the inconvenient loss of information stored in the memory of the card. Detachment of the computer card could occur for various reasons, such as when the computer card is removed and a different card is coupled to the host computer. During times when computer card is not coupled to the host computer, the computer card continues to draw current and drain the battery. Thus, there is a risk that a low battery condition could occur and be unrecognized in a conventional computer card that is detached from the host computer.

It may be appreciated by now that there has been provided a computer card, such as a PCMCIA card, which is able to independently provide a low battery indication to a user.

We claim:

1. A method for providing a low battery indication in an electronic device powered by a battery, the electronic device having an interface for transmitting data to a host computer and an annunciator for generating an alert, the method comprising the steps of:

(a) monitoring the battery voltage;

(b) determining that the battery voltage has fallen below a predetermined threshold voltage;

(c) providing, in response to step (b), a low battery indication to the interface only when the interface is coupled to the host computer; and (d) activating, in response to step (b), the annunciator only when the interface is not coupled to the host computer.

2. A battery powered electronic device for coupling to a host computer, the electronic device comprising:

an interface for transmitting data to the host computer;

an annunciator for generating an alert;

interface monitoring means coupled to the interface for determining an interface status as being active or inactive;

voltage monitoring means coupled to a battery for monitoring the battery voltage;

threshold detection means coupled to the voltage monitoring means for detecting that the battery voltage has fallen below a predetermined threshold voltage and generating a low battery signal in response thereto; and control means for receiving the low battery signal, wherein the control means, in response to reception of the low battery signal, provides a low battery indication to the interface when the interface has an active status and provides an activation signal to the annunciator when the interface has an inactive status.

3. The electronic device in accordance with claim 2, wherein the interface is defined in accordance with PCMCIA (Personal Computer Memory Card International Association) standards.

4. The electronic device in accordance with claim 2, wherein the annunciator is a transducer for generating an audible alert.

5. The electronic device in accordance with claim 2, wherein the annunciator is a light source for generating a visible alert.

6. The electronic device in accordance with claim 2, further comprising a memory coupled to the interface and the control means for storing information and for transferring the information to the interface in response to reception of a control signal generated by the control means.

7. The electronic device in accordance with claim 6, wherein the memory is a read only memory (ROM).

8. The electronic device in accordance with claim 6, wherein the memory is a random access memory (RAM).

9. The electronic device in accordance with claim 2, further comprising:

receiving means coupled to the control means for receiving a radio frequency (RF) signal and decoding therefrom a selective call message; and a memory coupled to the control means and the interface for storing the selective call message and for transferring the selective call message to the interface in response to reception .Dr a control signal generated by the control means.

10. The electronic device in accordance with claim 9, wherein the memory is a random access memory (RAM).

11. The electronic device in accordance with claim 9, wherein the receiving means comprises:

an antenna for receiving the RF signal;

a receiver coupled to the antenna for demodulating the RF signal; and a decoder coupled to the receiver for recovering the selective call message from the demodulated signal.

12. A battery powered data communication receiver for coupling to a host computer, the data communication receiver comprising:

an interface for transmitting data to the host computer;

an annunciator for generating an alert;

interface monitoring means coupled to the interface for determining an interface status as being active or inactive;

voltage monitoring means coupled to a battery for monitoring the battery voltage;

threshold detection means coupled to the voltage monitoring means for detecting that the battery voltage has fallen below a predetermined threshold voltage and generating a low battery signal in response thereto;

control means for receiving the low battery signal, wherein the control means, in response to reception of the low battery signal, provides a low battery indication to the interface when the interface has an active status and provides an activation signal to the annunciator when the interface has an inactive status;

receiving means coupled to the control means for receiving a radio frequency (RF) signal and decoding therefrom a selective call message; and a memory coupled to the control means and the interface for storing the selective call message and for transferring the selective call message to the interface in response to reception of a control signal generated by the control means.

13. The data communication receiver in accordance with claim 12, wherein the interface is defined in accordance with PCMCIA (Personal Computer Memory Card International Association) standards.

14. The data communication receiver in accordance with claim 12, wherein the annunciator is a transducer for generating an audible alert.

15. The data communication receiver in accordance with claim 12, wherein the annunciator is a light source for generating a visible alert.

16. The data communication receiver in accordance with claim 12, wherein the memory is a random access memory (RAM).

17. The data communication receiver in accordance with claim 12, wherein the receiving means comprises:

an antenna for receiving the RF signal;

a receiver coupled to the antenna for demodulating the RF signal; and a decoder coupled to the receiver for recovering the selective call message from the demodulated signal.

* * * * *

UNITED STATES PATENT AND TRADEMARK OFFICE

CERTIFICATE OF CORRECTION

PATENT NO. : 5,365,221

DATED : November 15, 1994

INVENTOR(S) : Robert D. Fennell, et al.

It is certified that error appears in the above-indentified patent and that said Letters Patent is hereby corrected as shown below:

Column 8, line 4, delete ".Dr" and insert --of--.

Signed and Sealed this

Ninth Day of April, 1996

*Attest:*

*Attesting Officer*

BRUCE LEHMAN

*Commissioner of Patents and Trademarks*